US011136994B2

(12) United States Patent
Fujita et al.

(10) Patent No.: US 11,136,994 B2
(45) Date of Patent: Oct. 5, 2021

(54) CENTRIFUGAL COMPRESSOR AND TURBOCHARGER INCLUDING THE SAME

(71) Applicant: MITSUBISHI HEAVY INDUSTRIES ENGINE & TURBOCHARGER, LTD., Sagamihara (JP)

(72) Inventors: Yutaka Fujita, Tokyo (JP); Hironori Honda, Tokyo (JP); Nobuhito Oka, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 16/969,075

(22) PCT Filed: Apr. 4, 2018

(86) PCT No.: PCT/JP2018/014422
§ 371 (c)(1),
(2) Date: Aug. 11, 2020

(87) PCT Pub. No.: WO2019/193683
PCT Pub. Date: Oct. 10, 2019

(65) Prior Publication Data
US 2021/0033107 A1 Feb. 4, 2021

(51) Int. Cl.
*F04D 29/44* (2006.01)

(52) U.S. Cl.
CPC ..... *F04D 29/444* (2013.01); *F05D 2220/40* (2013.01); *F05D 2250/52* (2013.01)

(58) Field of Classification Search
CPC . F04D 29/444; F05D 2220/40; F05D 2250/52
See application file for complete search history.

(56) References Cited

U.S. PATENT DOCUMENTS 3,788,765 A * 1/1974 Rusak ..... F04D 29/284 415/227
4,790,720 A * 12/1988 Rodgers ..... F04D 29/444 415/208.3

(Continued)

FOREIGN PATENT DOCUMENTS

JP 2008-175124 A 7/2008
JP 2015-190383 A 11/2015

(Continued)

OTHER PUBLICATIONS

Extended European Search Report for European Application No. 18913939.7, dated Nov. 23, 2020.

(Continued)

*Primary Examiner* — Michael Lebentritt
(74) *Attorney, Agent, or Firm* — Birch, Stewart, Kolasch & Birch, LLP

(57) ABSTRACT

In a centrifugal compressor including an impeller rotatably disposed in a housing, the housing includes a shroud wall and a hub wall, which define a diffuser passage communicating with an outlet of the impeller. The diffuser flow passage includes a pinched part configured such that the shroud wall is closer to the hub wall radially outward of the centrifugal compressor from the outlet of the impeller, and a parallel part communicating with the pinched part on a radially outer side of the centrifugal compressor than the pinched part, the parallel part being configured such that the shroud wall and the hub wall are parallel to each other. The shroud wall has a surface facing the impeller and the hub wall, the surface having a cross-sectional shape where a tangent line exists at any position in a cross-section including an axis of the impeller.

3 Claims, 7 Drawing Sheets

(56) References Cited

U.S. PATENT DOCUMENTS 4,815,935 A * 3/1989 Gottemoller ..... F04D 29/444 415/211.1
4,877,373 A * 10/1989 Bandukwalla ..... F04D 29/444 415/208.4
5,685,696 A * 11/1997 Zangeneh ..... F04D 29/284 416/186 R
6,224,321 B1 * 5/2001 Ebden ..... F01D 5/048 415/9
6,508,626 B1 * 1/2003 Sakurai ..... F04D 29/284 416/180
7,628,583 B2 * 12/2009 Roberts ..... F04D 29/444 415/208.3
2005/0260074 A1 * 11/2005 Higashimori ..... F04D 21/00 415/206
2009/0035122 A1 * 2/2009 Yagi ..... F04D 29/284 415/1
2012/0102969 A1 * 5/2012 Wagner ..... F04D 29/284 60/785
2014/0369823 A1 * 12/2014 Yamashita ..... F04D 29/284 415/203
2015/0132120 A1 * 5/2015 Yoeda ..... F01D 9/026 415/204
2016/0084263 A1 3/2016 Morita
2016/0097297 A1 4/2016 Twist et al.
2016/0195100 A1 * 7/2016 Alban ..... F04D 29/284 415/120
2017/0152019 A1 * 6/2017 Wood ..... F04D 29/324
2017/0268528 A1 * 9/2017 Rodriguez Erdmenger ..... F04D 29/30
2018/0266433 A1 * 9/2018 Iurisci ..... F04D 17/02
2020/0056624 A1 * 2/2020 Saito ..... F04D 29/444
2020/0063751 A1 * 2/2020 Iwakiri ..... F04D 29/30
2020/0318653 A1 * 10/2020 Sakamoto ..... F04D 29/023
2020/0386241 A1 * 12/2020 Saito ..... F04D 17/122
2021/0054850 A1 * 2/2021 Ishikawa ..... F04D 17/10

FOREIGN PATENT DOCUMENTS

JP 6112223 B2 4/2017
WO WO 2006/018591 A1 2/2006
WO WO 2014/006751 A1 1/2014

OTHER PUBLICATIONS

International Preliminary Report on Patentability and Written Opinion of the International Searching Authority for International Application No. PCT/JP2018/014422, dated Oct. 15, 2020, with an English translation.
International Search Report for International Application No. PCT/JP2018/014422, dated Jul. 3, 2018.
Office Action dated Apr. 27, 2021 issued in counterpart Japanese Application No. 2020-512157 with a Machine Translation.

* cited by examiner

CENTRIFUGAL COMPRESSOR AND TURBOCHARGER INCLUDING THE SAME

TECHNICAL FIELD

The present disclosure relates to a centrifugal compressor and a turbocharger including the same.

BACKGROUND

A centrifugal compressor such as a turbocharger includes a diffuser passage and a scroll passage on a discharge side of an impeller. A fluid compressed by the impeller flows into the scroll passage after a flow velocity thereof is decreased in the diffuser passage and a part of a dynamic pressure component thereof is converted to a static pressure. The diffuser passage generally includes a shape in which two walls defining the diffuser passage are parallel to each other (parallel walls), and a shape which includes a portion where an interval between the two walls decreases radially outward (pinched wall). For example, Patent Document 1 describes a centrifugal compressor including a diffuser passage formed by a pinched wall.

CITATION LIST

Patent Literature

Patent Document 1: JP6112223B

SUMMARY

Technical Problem

As the diffuser passage formed by the pinched wall, for example, as shown in FIG. 6, in a diffuser passage 100 defined between a shroud wall 102 and a hub wall 103, a configuration is assumed in which the diffuser passage 100 includes a pinched part 110 and a parallel part 111. In the pinched part 110, the shroud wall 102 is inclined at a constant inclination so as to be closer to the hub wall 103 radially outward from an outlet portion 101 of an impeller 105. In the parallel part 111, the shroud wall 102 and the hub wall 103 are parallel to each other on the radially outer side of the pinched part 110. In a cross-section including an axis L of the impeller 105, an angle $\lambda$ is formed by a straight line $L_3$ and a tangent line. The straight line $L_3$ is obtained by extending a radially outermost part **106*a*1 of an outer peripheral edge part 106*a* of a blade 106 in the impeller 105 radially outward. The tangent line is at any position on the surface of the shroud wall 102. Moreover, regarding a distance R radially outward from the axis L of the impeller 105, $R_0$ is a distance from the axis L of the impeller 105 to the outlet portion 101 of the impeller 105, and $R_1$ is a distance from the axis L of the impeller 105 to a boundary portion 104 between the pinched part 110 and the parallel part 111**.

Referring to FIG. 7, in an R-$\lambda$ plane where the abscissa indicates R and the ordinate indicates $\lambda$, the relationship between R and $\lambda$ is represented as $\lambda=f(R)$ by a function f. In the range of $R\leq R_0$, the surface of the shroud wall 102 has a smooth decreasing function. However, $\lambda$ discontinuously increases at $R=R_0$ and in the range of $R_0\leq R<R_1$, the shroud wall 102 is inclined at the constant inclination, and thus $\lambda$ has a constant value. Moreover, $\lambda$ discontinuously decreases at $R=R_1$, and the shroud wall 102 and the hub wall 103 are parallel to each other in the range of $R\geq R_1$, and thus $\lambda$ has a constant value. Thus, discontinuous portions exist on the shroud wall 102 in the outlet portion 101 of the impeller 105, and the boundary portion 104 between the pinched part 110 and the parallel part 111. The problem arises in that a loss or separation occurs in such discontinuous portions.

In view of the above, an object of at least one embodiment of the present disclosure is to provide a centrifugal compressor suppressing occurrence of a loss or separation in the diffuser passage and a turbocharger including the same.

Solution to Problem (1) A centrifugal compressor according to at least one embodiment of the present invention is a centrifugal compressor including an impeller rotatably disposed in a housing. The housing includes a shroud wall and a hub wall, which define a diffuser passage communicating with an outlet of the impeller. The diffuser flow passage includes a pinched part configured such that the shroud wall is closer to the hub wall radially outward of the centrifugal compressor from the outlet of the impeller, and a parallel part communicating with the pinched part on a radially outer side of the centrifugal compressor than the pinched part, the parallel part being configured such that the shroud wall and the hub wall are parallel to each other. The shroud wall has a surface facing the impeller and the hub wall, the surface having a cross-sectional shape where a tangent line exists at any position in a cross-section including an axis of the impeller.

With the above configuration (1), since the surface of the shroud wall facing the impeller and the hub wall has the cross-sectional shape where the tangent line exists at any position in the cross-section including the axis of the impeller, the surface of the shroud wall has a smooth shape, and a discontinuous portion does not exist in the surface of the shroud wall. Thus, it is possible to suppress occurrence of a loss or separation in the diffuser passage.

(2) In some embodiments, in the above configuration (1), regarding a distance R radially outward of the centrifugal compressor from the axis of the impeller, provided that $R_0$ is a distance from the axis of the impeller to the outlet of the impeller, and $R_1$ is a distance from the axis of the impeller to a boundary portion between the pinched part and the parallel part, the cross-sectional shape in a range of $R_0\leq R\leq R_1$ is formed by a curved line curved into a convex shape with respect to the hub wall.

With the above configuration (2), since the cross-sectional shape of the surface of the shroud wall in the range of $R_0\leq R\leq R_1$ is formed by the curved line curved into the convex shape with respect to the hub wall, the curved line in the range of $R_0\leq R\leq R_1$ can smoothly be connected to each of a cross-section of the surface of the shroud wall in the range of $R\leq R_0$ and a cross-section of the surface of the shroud wall in the range of $R\geq R_1$. Thus, it is possible to configure the pinched part so the discontinuous portion is not formed in the surface of the shroud wall.

(3) In some embodiments, in the above configuration (1), regarding a distance R radially outward of the centrifugal compressor from the axis of the impeller, provided that $R_0$ is a distance from the axis of the impeller to the outlet of the impeller, and $R_1$ is a distance from the axis of the impeller to a boundary portion between the pinched part and the parallel part, the cross-sectional shape in a range of $R_0\leq R\leq R_1$ is formed by a curved line including a first curved line curved into a concave shape with respect to the hub wall in a range of $R_0 \leq R \leq R_1$ ($R_0 < R_2 < R_1$), and a second curved line curved into a convex shape with respect to the hub wall in a range of $R_2 \leq R \leq R_1$.

If the cross-sectional shape of the surface of the shroud wall in the range of $R_0 \leq R \leq R_1$ is formed by only the curved line curved into the convex shape with respect to the hub wall, a constraint may be imposed on the shape of the diffuser passage. However, with the above configuration (3), since the cross-sectional shape in the range of $R_0 \leq R \leq R_1$ is formed by the curved line including the first curved line curved into the concave shape with respect to the hub wall in the range of $R_0 \leq R \leq R_2$($R_0 < R_2 < R_1$), and the second curved line curved into the convex shape with respect to the hub wall in the range of $R_2 \leq R \leq R_1$, it is possible to configure the pinched part so a discontinuous portion is not formed in the surface of the shroud wall while relaxing the constraint on the shape of the diffuser passage.

(4) In some embodiments, in any one of the above configurations (1) to (3), provided that, in the cross-section including the axis of the impeller, $\lambda$ is an angle between the tangent line and a straight line obtained by extending a radially outermost part of an outer peripheral edge part of a blade in the impeller radially outward, $\lambda = f(R)$ represents a relationship between the R and the $\lambda$ by a function f in a range of $R_0 \leq R < R_1$, and $f'(R)$ is a first derivative of $f(R)$, $f'(R) < 0$ holds in the range of $R_0 \leq R < R_1$.

With the above configuration (4), since the shroud wall is configured to be smoothly closer to the hub wall radially outward in the pinched part, it is possible to suppress the occurrence of the loss or separation in the diffuser passage.

(5) A turbocharger according to at least one embodiment of the present invention includes the centrifugal compressor according to any one of the above configurations (1) to (4).

With the above configuration (5), since the surface of the shroud wall facing the impeller and the hub wall has the cross-sectional shape where the tangent line exists at any position in the cross-section including the axis of the impeller, the surface of the shroud wall has a smooth shape, and a discontinuous portion does not exist in the surface of the shroud wall. Thus, it is possible to suppress the occurrence of the loss or separation in the diffuser passage.

Advantageous Effects

According to at least one embodiment of the present disclosure, since the surface of the shroud wall facing the impeller and the hub wall has the cross-sectional shape where the tangent line can exist at any position in the cross-section including the axis of the impeller, the surface of the shroud wall has a smooth shape, and a discontinuous portion does not exist in the surface of the shroud wall. Thus, it is possible to suppress occurrence of a loss or separation in the diffuser passage.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

A centrifugal compressor according to some embodiments of the present disclosure to be shown below will be described by taking a centrifugal compressor of a turbocharger as an example. However, the centrifugal compressor in the present disclosure is not limited to the centrifugal compressor of the turbocharger, and may be any centrifugal compressor operating independently. In the following description, a fluid compressed by the compressor is air. However, the fluid can be replaced with any fluid.

EMBODIMENT 1

Figure 1:
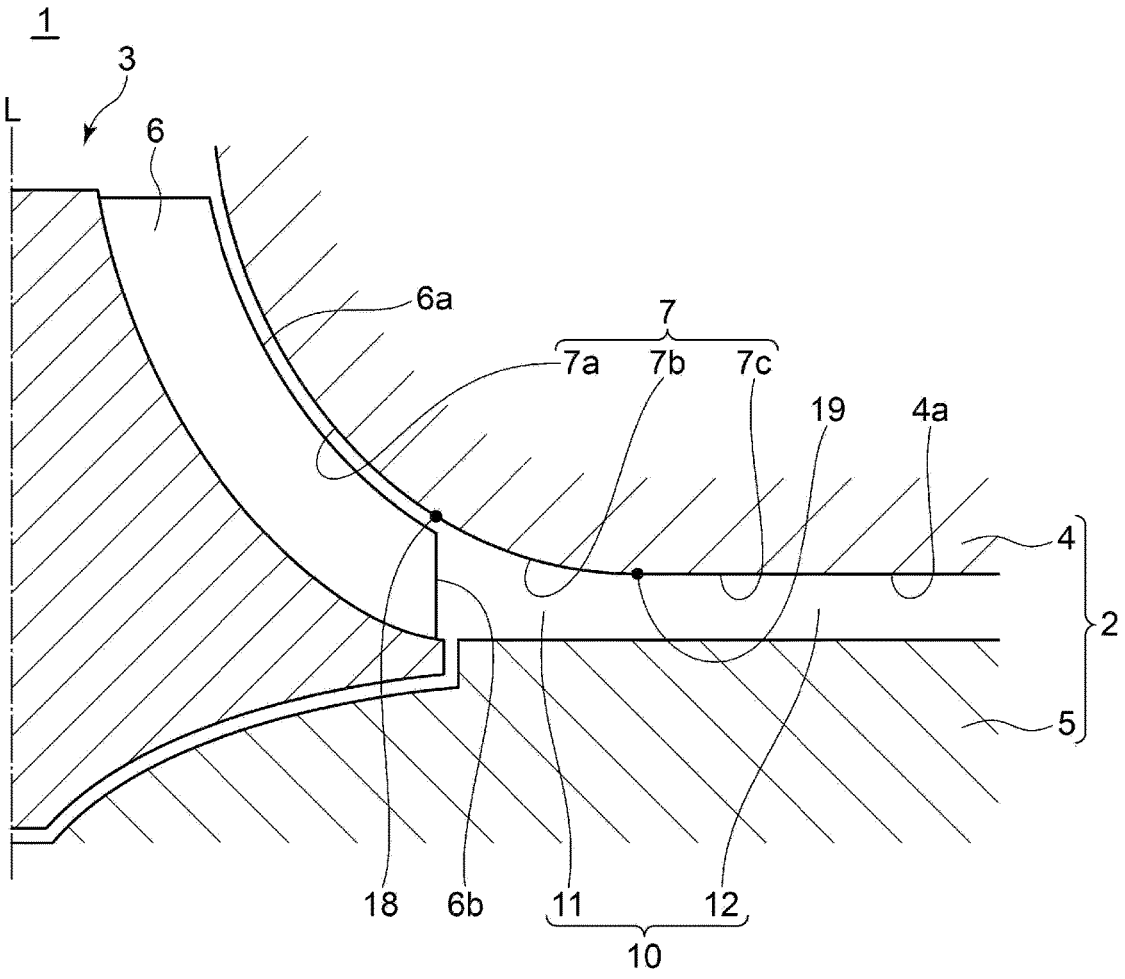
FIG. 1 is a cross-sectional view of a centrifugal compressor according to Embodiment 1 of the present disclosure.

As shown in FIG. 1, a centrifugal compressor 1 according to Embodiment 1 of the present disclosure includes a housing 2 and an impeller 3 disposed so as to be rotatable about the axis L in the housing 2. The housing 2 includes a shroud wall 4 and a hub wall 5. Between the shroud wall 4 and the hub wall 5, a diffuser passage 10 communicating with an outlet of the impeller 3 along the periphery of the impeller 3 is defined.

The diffuser passage 10 includes a pinched part 11 and a parallel part 12. The pinched part 11 extends radially outward of the centrifugal compressor 1 (to be simply referred to as "radially outward" hereinafter) from the outlet of the impeller 3. The parallel part 12 communicates with the pinched part 11 on the radially outer side of the pinched part 11 and extends radially outward. The pinched part 11 is configured such that the shroud wall 4 is closer to the hub wall 5 radially outward. That is, the pinched part 11 is configured such that a flow passage width in the direction of the axis L of the impeller 3 decreases radially outward. The parallel part 12 is configured such that the shroud wall 4 and the hub wall 5 are parallel to each other.

The shroud wall 4 has a surface 4*a* facing the impeller 3 and the hub wall 5. The surface 4*a* has a cross-sectional shape 7 formed by a curved line 7*a*, a curved line 7*b*, and a straight line 7*c* in a cross-section including the axis L of the impeller 3. The curved line 7*a* is curved smoothly into a convex shape in a portion along an outer peripheral edge part 6*a* of a blade 6 in the impeller 3. The curved line 7*b* is smoothly curved into a convex shape in a portion defining the pinched part 11. The straight line 7*c* horizontally extends radially outward in a portion defining the parallel part 12. The curved line 7*a* and the curved line 7*b* are smoothly connected in a boundary portion 18 positioned in the outlet of the impeller 3. The curved line 7*b* and the straight line 7*c* are smoothly connected in a boundary portion 19 positioned radially outer side of the boundary portion 18.

Since, in the cross-section including the axis L of the impeller 3, the curved lines 7*a* and 7*b* are each smoothly curved into the convex shape, the curved line 7*a* and the curved line 7*b* are smoothly connected, and the curved line 7*b* and the straight line 7*c* are smoothly connected, the surface 4*a* of the shroud wall 4 continues smoothly, and a discontinuous portion, such as a sharp projection or recess, does not exist in the surface 4*a*. A trailing edge part 6*b* of the blade 6 in the impeller 3 is configured to be parallel to the axis L of the impeller 3.

Next, the fact that the surface 4*a* of the shroud wall 4 has the smooth continuous shape will be described in more detail.

Figure 2:
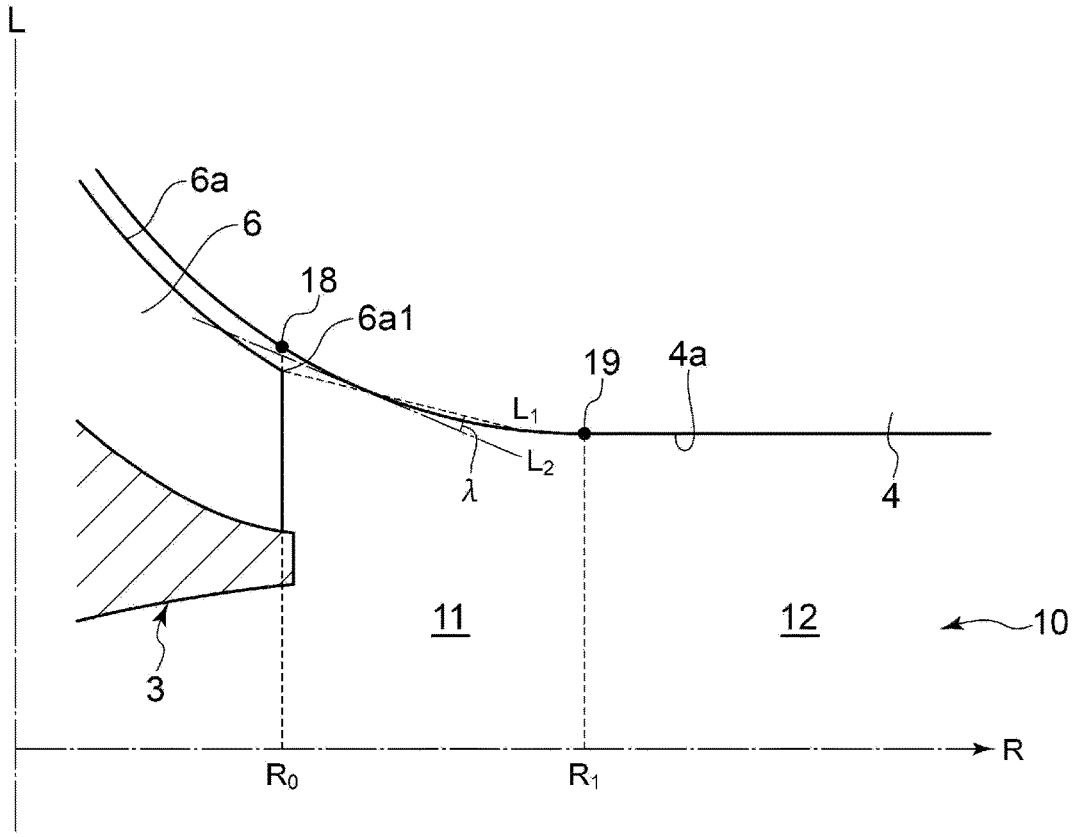
FIG. 2 is a partially enlarged cross-sectional view of a diffuser passage in the centrifugal compressor according to Embodiment 1 of the present disclosure.

As shown in FIG. 2, in the cross-section including the axis L of the impeller 3, the angle λ is formed by the straight line $L_1$ and a tangent line $L_2$. The straight line $L_1$ is obtained by extending the radially outermost part 6*a*1 of the outer peripheral edge part 6*a* of the blade 6 in the impeller 3 radially outward. The tangent line $L_2$ is at any position on the surface 4*a*. Moreover, regarding the distance R radially outward from the axis L of the impeller 3, $R_0$ is the distance from the axis L of the impeller 3 to the outlet of the impeller 3, that is, the boundary portion 18, and $R_1$ is the distance from the axis L of the impeller 3 to the boundary portion 19 between the pinched part 11 and the parallel part 12.

Figure 3:
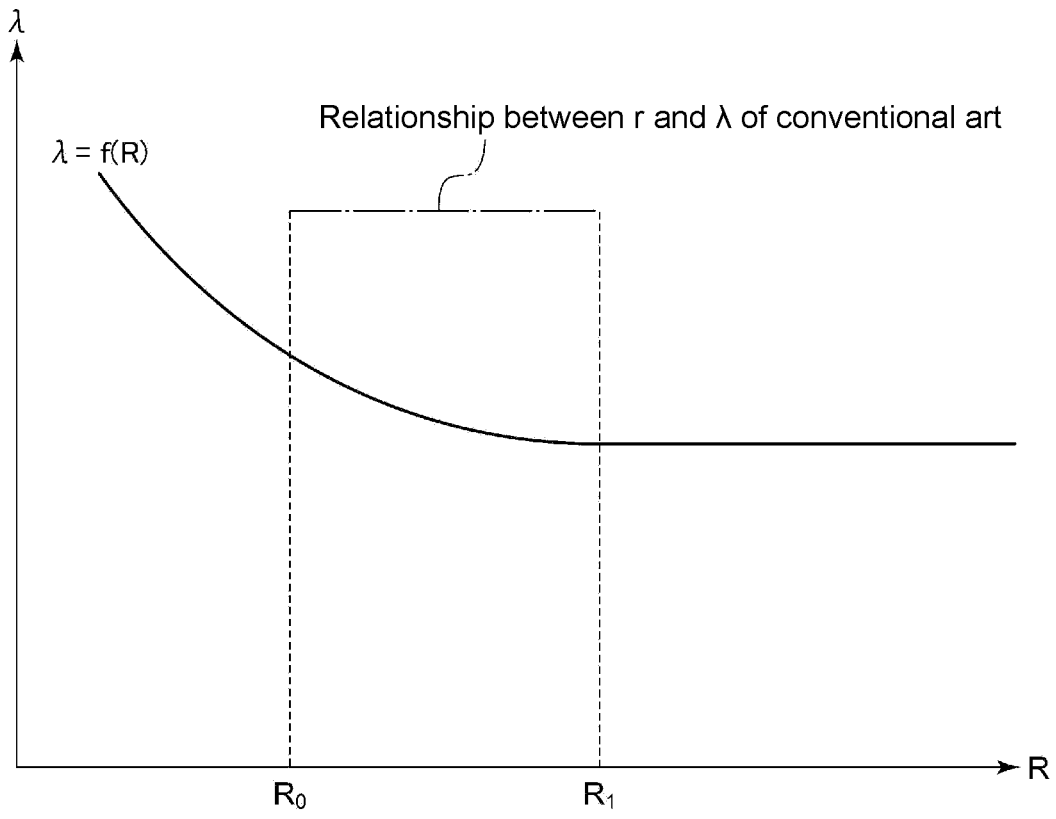
FIG. 3 is a schematic graph showing the relationship between R and $\lambda$ in the diffuser passage in the centrifugal compressor according to Embodiment 1 of the present disclosure.

As shown in FIG. 3, in the R–λ plane where the abscissa indicates R and the ordinate indicates λ, the relationship between R and λ is represented as λ=f(R) by the function f. In the range of $R \le R_0$, the surface 4*a* is along the outer peripheral edge part 6*a* of the blade 6 (see FIG. 2), and thus the function λ=f(R) is a smooth decreasing function which is convex downward. In the range of $R_0 \le R < R_1$, the shroud wall 4 is configured to be closer to the hub wall 5 radially outward (see FIG. 1), and thus the function λ=f(R) is a smooth decreasing function which is convex downward. In the range of $R \ge R_1$, the shroud wall 4 and the hub wall 5 are parallel to each other (see FIG. 1), and thus λ has a constant value, that is, the function λ=f(R) is a straight line parallel to the R axis.

As described above, since the surface 4*a* has the smooth continuous cross-sectional shape in the cross-section including the axis L of the impeller 3 (see FIG. 2), a discontinuous point does not exist in the function λ=f(R), and the function λ=f(R) is differentiable in any R. In other words, the surface 4*a* can have a cross-sectional shape where the tangent line $L_2$ can exist at any position in the cross-section including the axis L of the impeller 3. The shape is a smooth continuous shape where the discontinuous portion does not exist.

Figure 6:
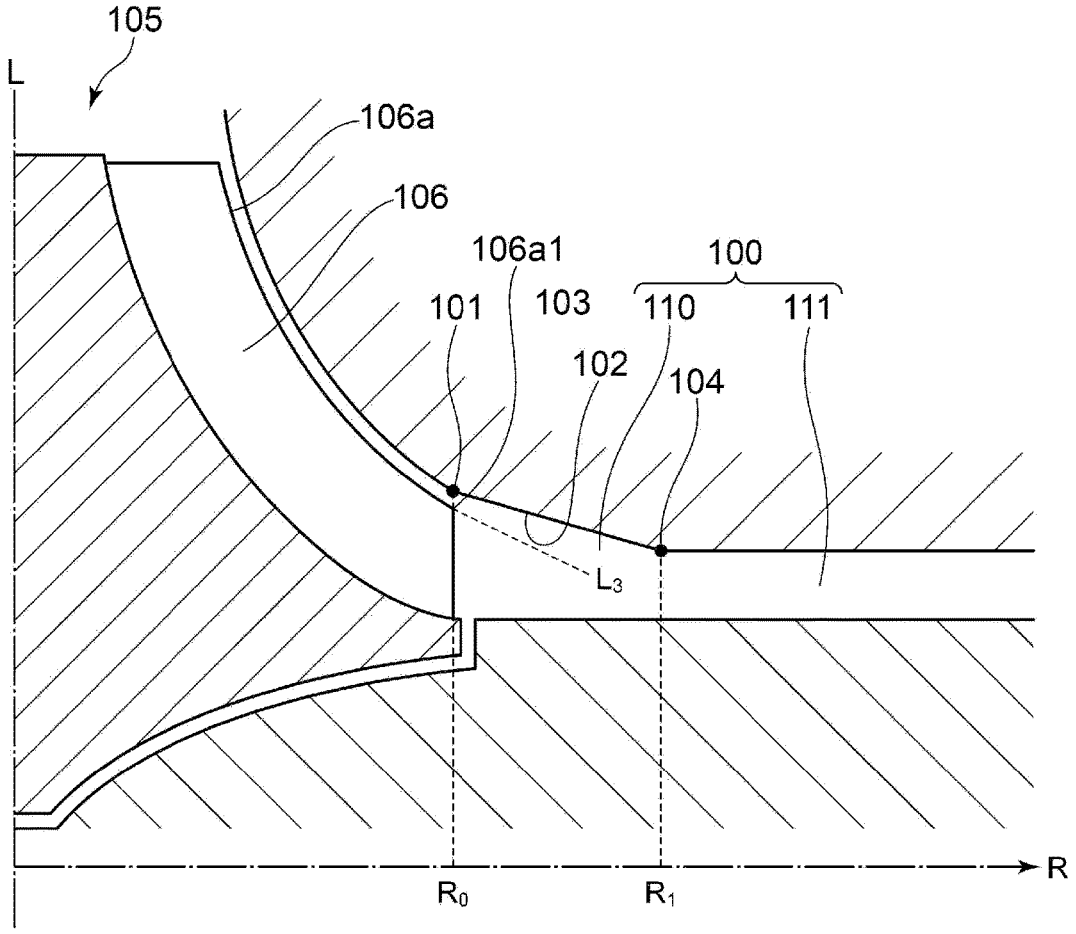
FIG. 6 is a schematic cross-sectional view of a conventional centrifugal compressor.
Figure 7:
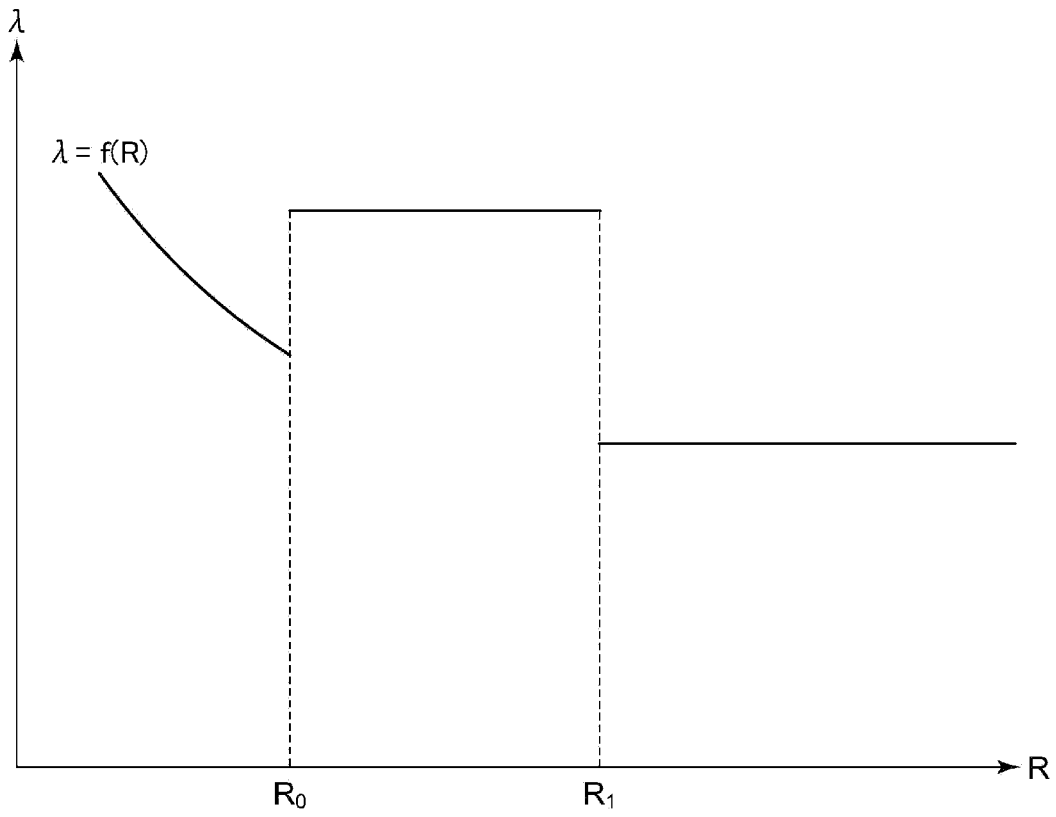
FIG. 7 is a schematic graph showing the relationship between R and $\lambda$ in a diffuser passage in the conventional centrifugal compressor.

By contrast, FIG. 3 also shows the relationship between R and λ in the shroud wall 102 shown in FIG. 7, which is indicated by a single-dotted chain line, as the diffuser passage of the conventional art formed by the pinched wall. As described above, in the configuration shown in FIG. 6, the discontinuous portions exist on the shroud wall 102 in the outlet portion 101 of the impeller 105, and the boundary portion 104 between the pinched part 110 and the parallel part 111.

Thus, in the diffuser passage of the conventional art formed by the pinched wall, the relationship between R and λ in the cross-sectional shape of the surface of the shroud wall 102 is discontinuous at each of $R=R_0$ and $R=R_1$. That is, a function representing the relationship between R and λ in the cross-sectional shape of the surface of the shroud wall 102 is not differentiable at each of $R=R_0$ and $R=R_1$. Further, in other words, in the cross-sectional shape of the shroud wall 102, a tangent line does not exist in the outlet portion 101 (see FIG. 6) and the boundary portion 104 (see FIG. 6).

Moreover, since the function λ=f(R) according to Embodiment 1 has a convex downward curved line in the range of $R_0 \le R \le R_1$ where the pinched part 11 (see FIG. 2) is formed, the convex downward curved line in the range of $R_0 \le R \le R_1$ can smoothly be connected to each of a convex downward curved line in the range of $R \le R_0$ and the straight line parallel to the R axis in the range of $R \ge R_1$. Thus, it is possible to configure the pinched part 11 so the discontinuous portion is not formed in the surface 4*a* of the shroud wall 4.

Furthermore, the function λ=f(R) is smoothly connected to the straight line parallel to the R axis representing the constant λ in the range of $R \ge R_1$, and thus a first-order differential coefficient f'(R1) is zero. However, in the range of $R_0 \le R < R_1$, λ decreases with an increase in R. That is, a first derivative f'(R) of f(R) is f'(R)<0 in the range of $R_0 \le R_1$. Thus, the shroud wall 4 (see FIG. 2) is configured to be closer to the hub wall 5 (see FIG. 2) radially outward in the pinched part (see FIG. 2).

As shown in FIG. 1, in the centrifugal compressor 1 according to Embodiment 1, air compressed by the rotation of the impeller 3 flows through the diffuser passage 10. Since the discontinuous portion does not exist in the surface 4*a* of the shroud wall 4 as described above, a loss or separation due to the discontinuous portion in the surface 4*a* does not occur when the air compressed by the rotation of the impeller 3 flows through the diffuser passage 10. Thus, it is possible to suppress the occurrence of the loss or separation in the diffuser passage 10.

EMBODIMENT 2

Next, the centrifugal compressor according to Embodiment 2 will be described. The centrifugal compressor according to Embodiment 2 is obtained by modifying the centrifugal compressor according to Embodiment 1 in the shape of the surface 4*a* of the shroud wall 4 in the portion defining the pinched part 11. In Embodiment 2, the same constituent elements as those in Embodiment 1 are associated with the same reference characters and not described again in detail.

Figure 4:
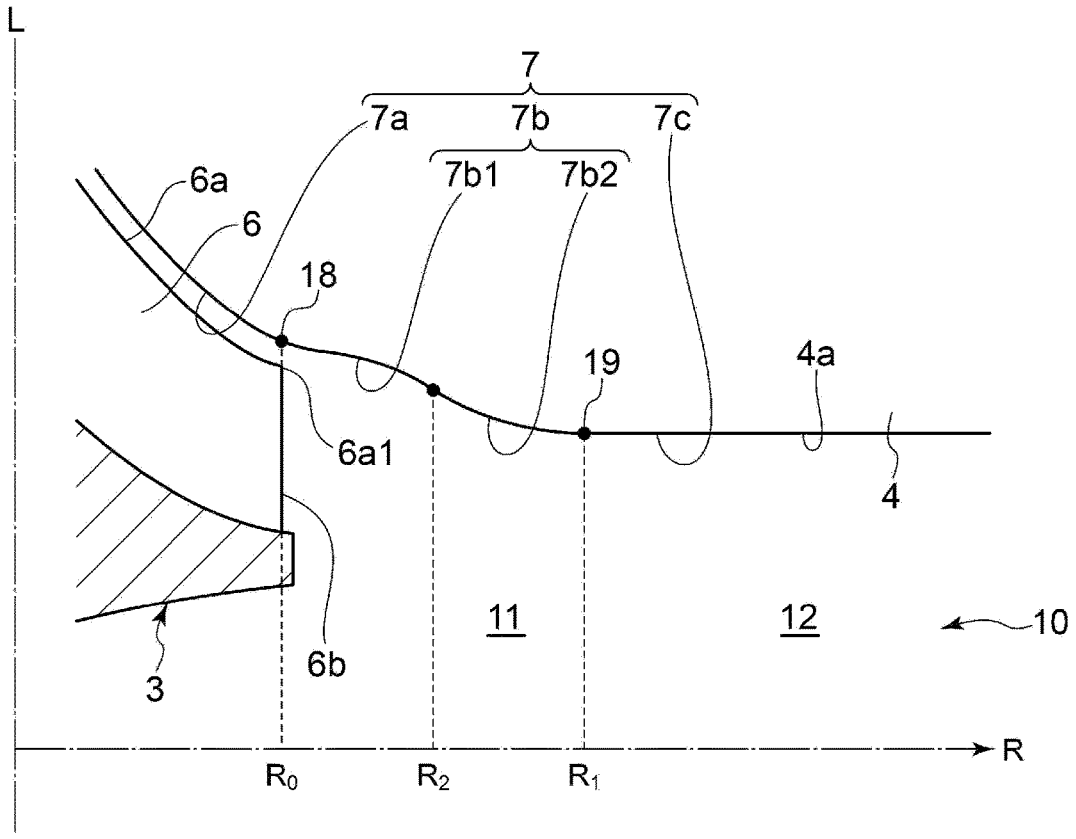
FIG. 4 is a partially enlarged cross-sectional view of the diffuser passage in the centrifugal compressor according to Embodiment 2 of the present disclosure.

As shown in FIG. 4, in the cross-section including the axis L of the impeller 3, the curved line 7*b* of the cross-sectional shape 7 of the surface 4*a* of the shroud wall 4 includes a first curved line 7*b*1 and a second curved line 7*b*2. The first curved line 7*b*1 is curved into a concave shape with respect to the hub wall 5 (see FIG. 1) in the range of $R_0 \le R \le R_2$ ($R_0 < R_2 < R_1$). The second curved line 7*b*2 is curved into a convex shape with respect to the hub wall 5 in the range of $R_2 \le R \le R_1$. The first curved line 7*b*1 and the second curved line 7*b*2 are smoothly connected. Other configurations are the same as Embodiment 1.

Figure 5:
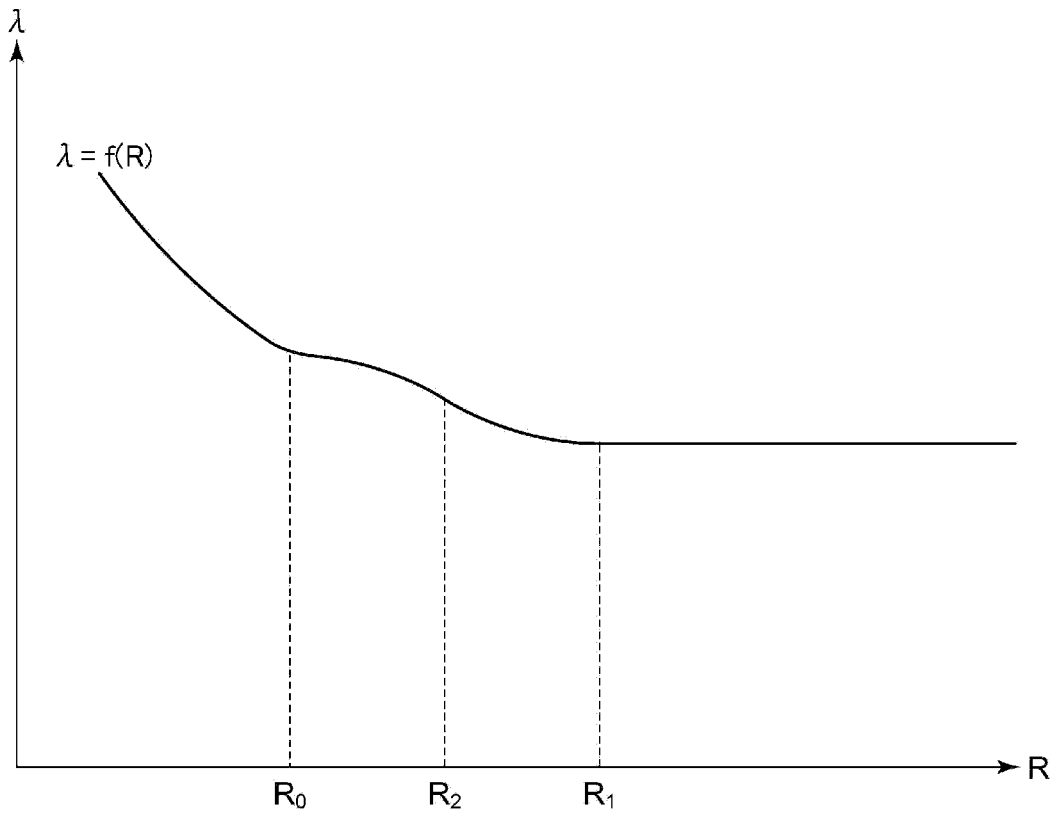
FIG. 5 is a schematic graph showing the relationship between R and $\lambda$ in the diffuser passage in the centrifugal compressor according to Embodiment 2 of the present disclosure.

FIG. 5 shows the function λ=f(R) representing the relationship between R and λ of the cross-sectional shape 7 of the surface 4*a* of the shroud wall 4 in the cross-section including the axis L of the impeller 3, in the centrifugal compressor according to Embodiment 2. In the range of $R \le R_0$ and the range $R \ge R_1$, of the function π=f(R) is the same as the function λ=f(R) according to Embodiment 1. On the other hand, in the range of $R_0 \le R \le R_2$, the function λ=f(R) is a convex upward decreasing function, and in the range of $R_2 \le R \le R_1$, the function λ=f(R) is a convex downward decreasing function.

In the Embodiment 2 as well, as described above, since the surface 4*a* has the smooth continuous cross-sectional shape in the cross-section including the axis L of the impeller 3 (see FIG. 4), a discontinuous point does not exist in the function $\lambda=f(R)$, and the function $\lambda=f(R)$ is differentiable in any R. In other words, the surface 4*a* can have a cross-sectional shape where the tangent line $L_2$ can exist at any position in the cross-section including the axis L of the impeller 3. The shape is a smooth continuous shape where the discontinuous portion does not exist.

If the curved line 7*b* is formed by only a curved line curved into a convex shape with respect to the hub wall 5 (see FIG. 1), in order to smoothly connect the curved line 7*b* and the straight line 7*c*, a constraint may be imposed on the shape of the diffuser passage 10. The constraint includes a need to cause the flow passage width of the parallel part 12 in the direction of the axis L to have a certain size or increasing the radial length of the pinched part 11 in order to decrease the flow passage width of the parallel part 12 in the direction of the axis L. Moreover, a case may be considered in which the shape of the blade 6 of the impeller 3 needs to be changed in order to form the diffuser passage 10 into a desired shape.

However, in Embodiment 2, since the curved line 7*b* includes the first curved line 7*b*1, which is curved into the concave shape with respect to the hub wall 5 in the range of $R_0 \leq R \leq R_2$ ($R_0<R_2<R_1$), and the second curved line 7*b*2, which is curved into the convex shape with respect to the hub wall 5 in the range of $R_2 \leq R \leq R_1$, it is possible to configure the pinched part 11 so a discontinuous portion is not formed in the surface 4*a* of the shroud wall 4 while relaxing the constraint on the shape of the diffuser passage 10, such as the constraint of the flow passage width of the parallel part 12 in the direction of the axis L or the radial length of the pinched part 11.

In the Embodiment 2 as well, since the discontinuous portion does not exist in the surface 4*a* of the shroud wall 4, the loss or separation due to the discontinuous portion in the surface 4*a* does not occur when the air compressed by the rotation of the impeller 3 flows through the diffuser passage 10. Thus, it is possible to suppress the occurrence of the loss or separation in the diffuser passage 10.

REFERENCE SIGNS LIST

1 Centrifugal compressor
2 Housing
3 Impeller
4 Shroud wall
4*a* Surface (of shroud wall)
5 Hub wall
6 Blade
6*a* Outer peripheral edge part (of blade)
6*a*1 Radially outermost part (of outer peripheral edge part of blade)
6*b* Trailing edge part (of blade)
7 Cross-sectional shape (of surface of shroud wall)
7*a* Curved line
7*b* Curved line
7*b*1 First curved line
7*b*2 Second curved line
7*c* Straight line
10 Diffuser passage
11 pinched part
12 parallel part
18 Boundary portion
19 Boundary portion
L Axis (of impeller)
R Distance

The invention claimed is:

1. A centrifugal compressor comprising an impeller rotatably disposed in a housing, wherein the housing includes a shroud wall and a hub wall, which define a diffuser passage communicating with an outlet of the impeller, wherein the diffuser flow passage includes:

a pinched part configured such that the shroud wall is closer to the hub wall radially outward of the centrifugal compressor from the outlet of the impeller; and a parallel part communicating with the pinched part on a radially outer side of the centrifugal compressor than the pinched part, the parallel part being configured such that the shroud wall and the hub wall are parallel to each other, wherein the shroud wall has a surface facing the impeller and the hub wall, the surface having a cross-sectional shape where a tangent line exists at any position in a cross-section including an axis of the impeller, and wherein, regarding a distance R radially outward of the centrifugal compressor from the axis of the impeller, provided that $R_0$ is a distance from the axis of the impeller to the outlet of the impeller, and $R_1$ is a distance from the axis of the impeller to a boundary portion between the pinched part and the parallel part, the cross-sectional shape in a range of $R_0 \leq R \leq R_1$ is formed by a curved line including:

a first curved line curved into a concave shape with respect to the hub wall in a range of $R_0 \leq R \leq R_2$ ($R_0<R_2<R_1$); and a second curved line curved into a convex shape with respect to the hub wall in a range of $R_2 \leq R \leq R_1$.

2. The centrifugal compressor according to claim 1, wherein, provided that, in the cross-section including the axis of the impeller, $\lambda$ is an angle between the tangent line and a straight line obtained by extending a radially outermost part of an outer peripheral edge part of a blade in the impeller radially outward, $\lambda=f(R)$ represents a relationship between the R and the $\lambda$ by a function f in a range of $R_0 \leq R<R_1$, and $f'(R)$ is a first derivative of $f(R)$, $f'(R)<0$ holds in the range of $R_0 \leq R<R_1$.

3. A turbocharger comprising the centrifugal compressor according to claim 1.

* * * * *